United States Patent [19]

Carter

[11] 3,981,628

[45] Sept. 21, 1976

[54] PUMP

[76] Inventor: James C. Carter, 1735 San Pasqual St., Pasadena, Calif. 91106

[22] Filed: Apr. 8, 1974

[21] Appl. No.: 459,022

[52] U.S. Cl. ..... 417/247; 415/68; 415/147; 417/424

[51] Int. Cl.[2] ..... F04D 13/12

[58] Field of Search ..... 417/205, 247, 274, 423, 417/424, 245, 282; 415/68, 60, 143, 147; 222/255

[56] References Cited

UNITED STATES PATENTS

| | | | |
|---|---|---|---|
| 760,035 | 5/1904 | Stumpf | 415/60 |
| 921,118 | 5/1909 | Kasley | 417/245 |
| 1,071,042 | 8/1913 | Fuller | 415/60 |
| 1,089,248 | 3/1914 | Michell | 417/245 |
| 1,462,151 | 7/1923 | Seymour | 415/61 |
| 1,669,309 | 5/1928 | Spillmann | 417/382 |
| 2,129,808 | 9/1938 | Bentley | 417/247 |
| 2,175,641 | 10/1939 | Replogle | 415/60 |
| 2,194,054 | 3/1940 | Peterson | 417/247 |
| 2,839,005 | 6/1958 | Means | 417/247 |
| 3,004,494 | 10/1961 | Corbett | 417/245 |
| 3,008,309 | 11/1961 | Alt | 415/68 |
| 3,250,440 | 5/1966 | Trout | 415/143 |
| 3,369,715 | 2/1958 | Carter | 415/143 |
| 3,559,964 | 2/1971 | Sell et al. | 415/143 |
| 3,601,989 | 8/1971 | Austin | 417/245 |

FOREIGN PATENTS OR APPLICATIONS

| | | | |
|---|---|---|---|
| 662,973 | 12/1951 | United Kingdom | 415/143 |
| 184,134 | 1966 | U.S.S.R. | 415/143 |

*Primary Examiner*—C.J. Hausar
*Attorney, Agent, or Firm*—Hill, Gross, Simpson, Van Santen, Steadman, Chiara & Simpson

[57] ABSTRACT

Submersible electric motor driven inducer equipped centrifugal pump units, especially suitable for the pumping of cryogenic fluids or fluids at their boiling point, and capable of maintaining full flow under low submergence conditions are provided by disconnecting the inducers from co-rotation with the main impeller shaft while still retaining the main shaft for support and are powered by a source in the unit such as a slip coupling, a hydraulic turbine driven by pumpage from the pump impeller, or a separate electric motor. These power sources drive the inducer at speeds slower than the pump impeller to develop the desired suction head for the impeller without drawing excessive power or producing undesirable thrusts and reduce pump-out time for the last few feet of cargo. A hydraulic or magnetic clutch coupling with the main electric motor drive may be used in combination with the turbine power source for the inducer to start the pumping action. The inducers preferably have two spiral blades and are preferably driven at about one-half to two-thirds the speed of the main impeller.

9 Claims, 7 Drawing Figures

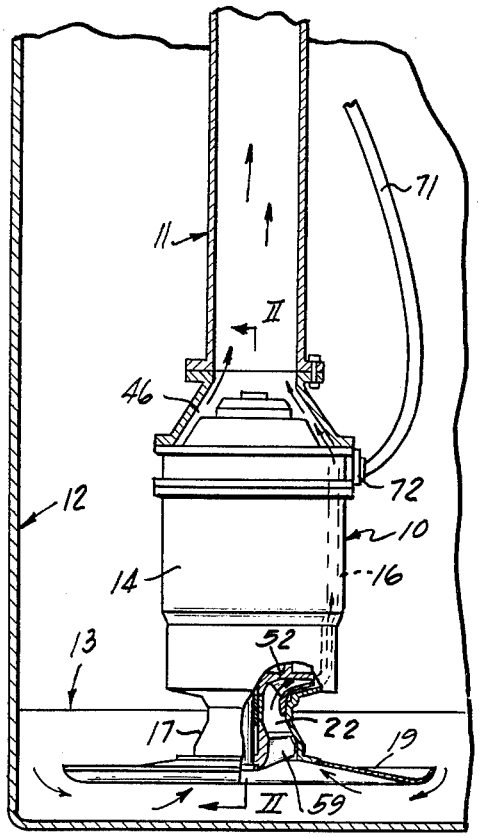
Fig. 1
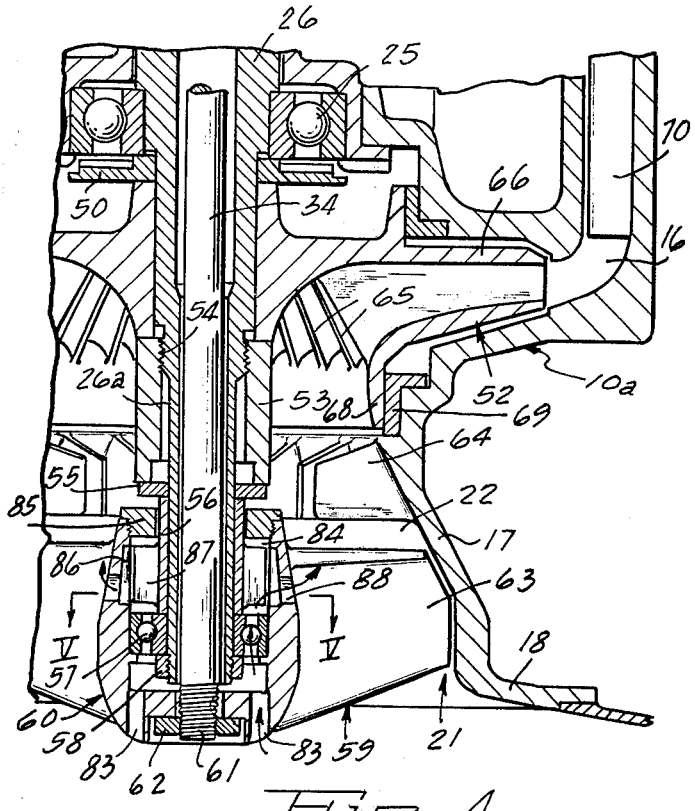
Fig. 4
Fig. 3
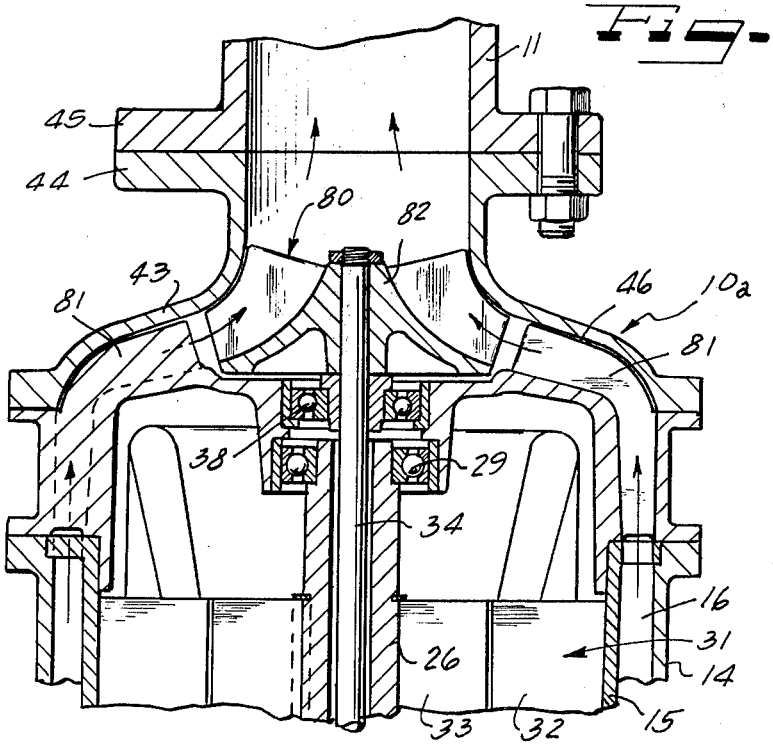

Fig. 7
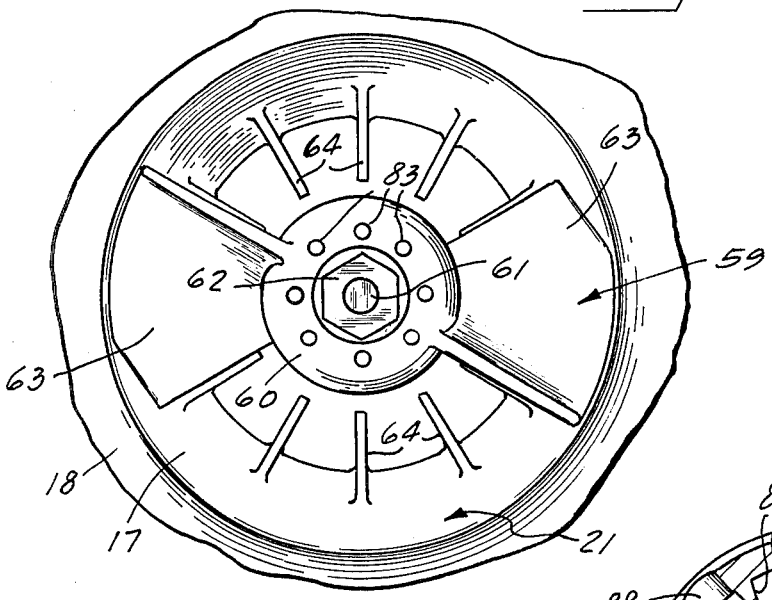
Fig. 5
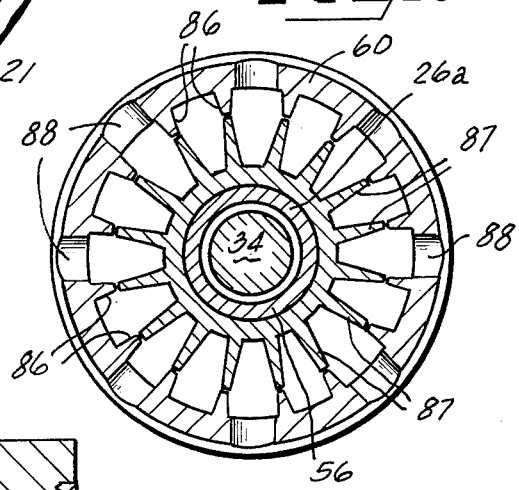
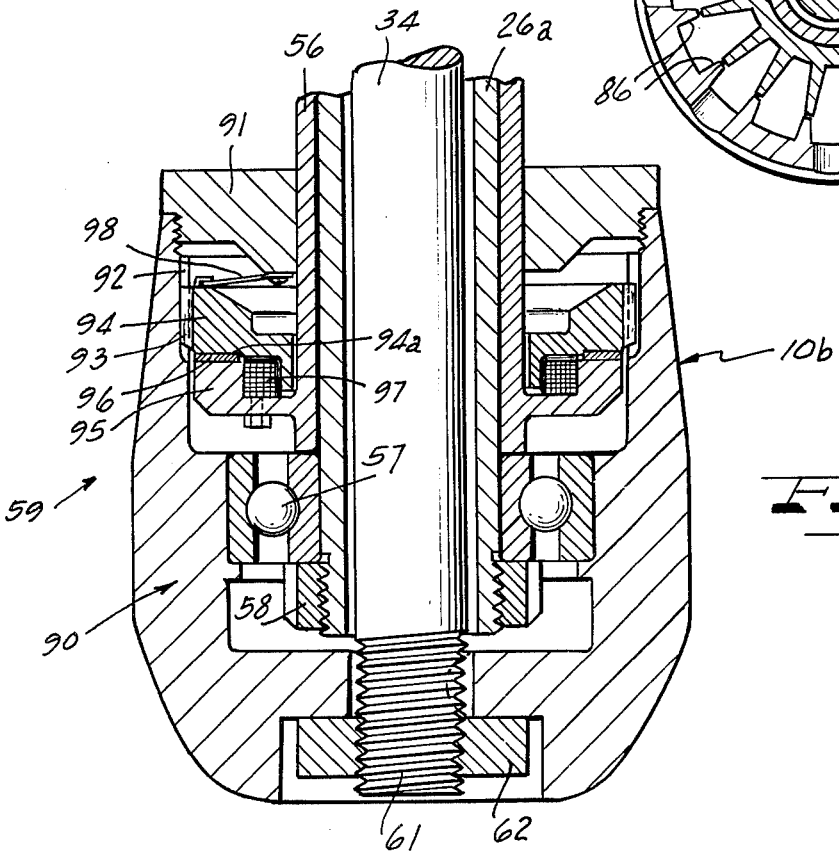
Fig. 6

PUMP

BACKGROUND OF THE INVENTION

1. Field of the Invention

This invention relates to the art of submersible electric motor driven centrifugal pump units having inducers in the pump inlet to develop a desired suction head for the main pump impeller under low submergence conditions and is particularly concerned with the driving of the inducers independently of the main impeller to develop the desired suction head to maintain full pump flow even during the pumping of fluid from the bottom of a tank and without drawing excess power or developing undesirable thrusts.

2. Prior Art

Inducer equipped submersible electric motor driven pump units adapted for the pumping of cryogenic fluids or fluids at their boiling points are known, for example, in my prior U.S. Pat. Nos. 3,304,877 issued Feb. 21, 1967; 3,369,715, issued Feb. 20, 1968; 3,652,186 issued Mar. 28, 1972; and 3,764,236, issued Oct. 9, 1973. In the units of these patents four blade inducers were mounted on the main pump shaft in the pump inlet ahead of the main pump impeller and, of course, had to be driven at the same speed as the impeller requiring excessive driving power, developing excessive thrust loads, and producing large amounts of vapor which was not reabsorbed or condensed before it entered the main impeller and thereby impaired the impeller capacity and reduced the suction head for the pump. These units were unable to develop a required suction head under low submergence conditions and excessive time was needed to pump out the last few feet or meters of cargo. In tanker ships such extra time at the discharge docks is costly and in some instances, such ships had to be moved before full cargo discharge. Since the impeller was forced to rotate at pump speed even under sufficient submergence conditions for maintaining a good suction head, it produced a head greatly in excess of that needed for the main impeller and in so doing, excess power was consumed and undesirable thrust was developed.

SUMMARY OF THE INVENTION

According to this invention, the inducers in the inlets of submersible electric motor driven centrifugal pump units are caused to develop a desired suction head for the main pump impeller under low submergence conditions by disconnecting the inducer from rotation by the main impeller shaft while retaining the main shaft support. The inducers of this invention are powered by a source in the unit, other than the electric motor drive for the main impeller such as for example, a hydraulic turbine driven by pumpage from the main pump impeller or a separate electric motor, or may be driven from the main electric motor through a magnetic or hydraulic slip coupling, at speeds less than the main impeller speed such as for example, from one-half to two-thirds the speed of the main impeller. When a turbine inducer drive is provided, a clutch or coupling drive from the main motor may be used to initiate rotation of the inducer for starting the pumping action to supply pumpage to the turbine. This initial or start-up drive is desirable under low submergence conditions of the unit where only the inducer is submerged in the fluid to be pumped. The units of this invention are especially suitable for pumping cryogenic fluids or fluids at their boiling points such as for example, ammonia, liquified natural gas, propane, and the like while submerged in these fluids in storage tanks or tanker ships.

It is then an object of this invention to provide a required suction head for a submersible centrifugal pump under low submergence conditions.

Another object is to increase the efficiency of submersible centrifugal pumps under low submergence conditions with an inducer in the inlet that is driven at a slower speed than the centrifugal impeller.

Another object of this invention is to provide an inducer equipped submersible electric motor driven pump unit suitable for pumping cryogenic fluids and fluids at their boiling points, with a separate drive for the inducer.

A still further object of this invention is to provide a submersible electric motor driven centrifugal pump unit with an inducer in the pump inlet disconnected from direct rotation by the main impeller shaft of the pump but supported from this main shaft and driven by a power source at speeds less than the main impeller speed.

A still further object of this invention is to provide an electric motor driven centrifugal pump unit with an inducer in the pump inlet that is driven from an independent source in the unit at speeds less than the impeller speed.

A still further object of this invention is to provide a submersible electric motor driven centrifugal pump with an inducer in the inlet thereof supported from the main pump shaft but driven through a slip coupling at speeds less than the speed of the shaft.

A still further object of this invention is to provide a submersible electric motor driven inducer equipped centrifugal pump unit with a turbine powered by pumpage from the centrifugal impeller driving the inducer.

A still further object of the invention is to provide a submersible electric motor driven inducer equipped centrifugal pump unit with a turbine drive in the unit for the inducer and a slip coupling between the main pump shaft and the inducer to drive the inducer on start-ups before sufficient pumpage is developed to drive the turbine.

Other and further objects of this invention will become apparent to those skilled in this art from the following detailed description of the annexed sheets of drawings which, by way of examples only, illustrate several embodiments of the invention.

IN THE DRAWINGS

FIG. 1 is a somewhat diagrammatic fragmentary elevational view with parts in vertical section of an electric motor driven centrifugal pump equipped with an inducer of this invention and mounted near the bottom of a tank containing a liquified gas or other fluid;

FIG. 3 is a view similar to FIG. 2 but illustrating the upper portion of the pump unit equipped with a turbine drive for the inducer;

FIG. 4 is a fragmentary sectional view of the lower portion of the unit of FIG. 3 drawn on a somewhat larger scale;

FIG. 5 is a cross sectional view along the line V—V of FIG. 4;

FIG. 6 is a fragmentary view similar to FIG. 4 but showing an electromagnetic clutch coupling between the motor shaft and inducer hub; and FIG. 7 is a bottom plan view of the pump inlet taken along the line VII—VII of FIG. 2.

AS SHOWN ON THE DRAWINGS

Figure 2:
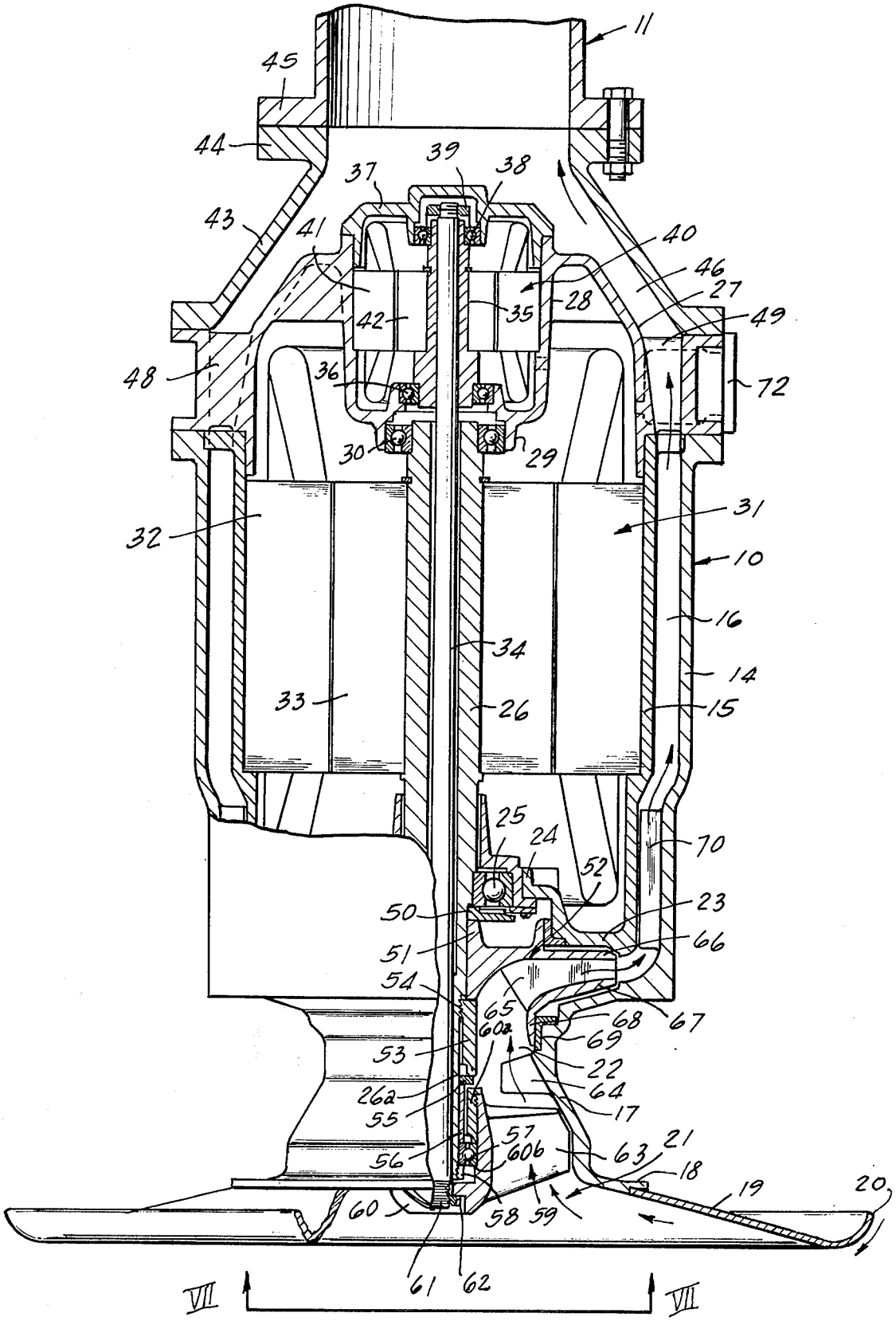
FIG. 2 is a vertical sectional view, with parts in elevation, taken along the line II—II of FIG. 1 showing the pump unit on a larger scale.

In FIG. 1 the reference numeral 10 designates generally, a submersible electric motor driven pump unit equipped with an inducer drive according to this invention and suspended from a vertical discharge pipe 11 in the bottom of a tank 12 containing cryogenic fluid or fluid near its boiling point 13. As shown, the level of the fluid 13 is low in the tank 12 but it will be appreciated, of course, that the unit 10 is completely submerged in the fluid when the tank is filled. The pipe 11 delivers fluid discharged from the unit 10 to the top of the tank. It should be understood that the unit 10 can be mounted as disclosed in any of my aforesaid U.S. Pat. Nos. 3,304,877; 3,369,715; 3,652,186; and 3,764,236.

As shown in FIG. 2, the unit 10 has a generally cylindrical outer casing 14 and a concentric inner casing 15 spaced therefrom to provide an annular passage 16 therebetween.

The bottom of the outer casing 14 has a reduced diameter depending neck portion 17 with an outwardly flared bottom flange 18 carrying a downwardly dished plate 19 with an upturned peripheral rim 20 spaced above the bottom of the tank as shown in FIG. 1. The plate 19 directs fluid to the bottom opening inlet mouth 21 to a chamber 22 provided by the neck 17.

The inner casing 15 has a bottom end wall 23 with a central hub portion 24 carrying a bottom ball bearing assembly 25 for a hollow pump shaft 26. An inverted cup-shaped or domed cover 27 secured on top of the casing 15 has a central depending cup-shaped inner casing 28 with a depending hub 29 slidably supporting a floating top ball bearing unit 30 having its inner race bottomed on a shoulder near the top of the hollow pump shaft 26. The shaft 26 is thus rotatably supported in an upright vertical position in the center of the inner casing 15.

An electric motor 31 is mounted in the inner casing 15 and has a field stator 32 surrounding a rotor 33 which surrounds and is secured to the pump shaft 26.

A solid shaft 34 extends freely through the hollow shaft 26 and through a superimposed hollow shaft 35 rotatably supported in the center of the casing portion 28 by a bottom bearing 36 and from a casing cover 37 by a top bearing 38. The top end of this shaft 34 is suspended from the top of the superimposed hollow shaft 35 by a key nut 39.

The casing portion 28 houses a second electric motor 40 with a stator field 41 surrounding a rotor armature 42 which receives the shaft 35 therethrough and is secured to the shaft for corotation.

The outer casing 14 has a hollow conical head or dome 43 overlying the cap or lid 27 of the casing portion 15 in spaced relation and having an outturned flange 44 at its upper end bolted to a mating outturned flange 45 of the pipe 11. A converging annular chamber 46 is thus provided between the covers or domes 27 and 43 joining the top of the annular chamber 16 with the pipe 11. Circumferential fins 48 with spaces 49 therebetween support the inner casing 15 and its cover from the outer casing and the spaces 49 provide open communication between the annular chambers 16 and 46.

The bottom end of the hollow main shaft 26 projects beyond the bottom end wall 23 of the inner casing 15 through a bearing cover plate 50 underlying and rotating with the bearing unit 25, next, through the hub 51 of the main pump impeller 52, and then through a sleeve 53 which is threaded at 54 onto the shaft and thus clamps the hub 51 of the impeller 52 between the plate 50 and the sleeve. The impeller 52 is also keyed to this hollow shaft 26 to insure corotation with the shaft.

The shaft 26 then has a reduced diameter hollow end portion **26*a* extending through the sleeve 53 and through a thrust washer 55 on top of a sleeve 56 surrounding the reduced diameter portion. A ball bearing unit 57 underlies the sleeve 56 and has its inner race clamped to the bottom of the sleeve by a nut 58 which is threaded on the bottom end of the reduced diameter shaft portion 26*a***.

According to this invention, a multi-blade, preferably a two blade inducer impeller 59 is mounted in the inlet mouth 21 of the chamber 22 and has a cup-like hub 60 carried by the ball bearing unit 57 for free rotation around the shaft portion **26*a*. A sleeve plug 60*a* threaded in the open top of the hub 60 is bottomed on the outer race of the bearing 57 which in turn is bottomed on a shoulder 60*b*** in the hub.

The bottom end of the inner solid shaft 34 is threaded at 61 and the bottom of the hub 60 of the inducer 59 is keyed on this end 61 and securely locked thereto by a nut 62 which is threaded on the end 61.

As best shown in FIG. 7, the inducer 59 has two spiral blades 63 projecting radially from diametrically opposite sides of the hub 60 and riding close to the inner surface of the neck 17 to axially propel fluid from the inlet mouth 21 into the chamber 22. The inlet is not covered by the blades 63 and fluid can freely flow into the chamber 22 even when the inducer is idle. Thus, under high head submergence, the inducer may not be driven and since it is free to rotate, the incoming fluid may cause it to rotate.

A ring of circumferentially spaced flow directing vanes 64 project into the chamber 22 from the neck 17 to direct the fluid from the inducer vanes 63 to the vanes 65 of the main centrifugal impeller 52, as shown in FIG. 2. This impeller 52 is of the shrouded type having the vanes depending from a top disk or wall 66 radiating from the hub 51 and covered by a bottom shroud 67 with a depending collar 68 that rides in a bearing ring 69 carried by the neck 17.

The impeller vanes 65 discharge into the space 16 between the outer casing 14 and inner casing 15 and a ring of circumferentially spaced radial vanes 70 in the space 16 direct the fluid axially so that it flows upwardly to the outlet chamber 46 and pipe 11.

The electric motor 31 thus directly drives the impeller 52 through the hollow shaft 26.

The inducer 59 is freely mounted on the bottom end of the hollow shaft 26 but is driven from the electric motor 40 by the shaft 34 which is telescoped through the shaft 26.

Electric current for both motors 31 and 40 is supplied through a cable 71 coupled through a journal box 72 with the outer casing.

Since suction specific speed is considered a measure of a centrifugal pump's ability to perform under low inlet heads, it is very important in pumps used to pump out tanks, ships, and the like because both the maximum rate of pump out of the last few feet of cargo and the final amount of fluid remaining in the tank are affected by this speed. Suction specific speed is represented by the following formula:

$$\text{Suction Specific Speed} = \frac{\text{RPM} \times \sqrt{GPM}}{(\text{Suction head required})^{3/4}}$$

where RPM is the speed of the impeller, GPM is the gallons per minute of pumpage flowing from the pump, and suction head is the head of the fluid above the pump inlet. From this formula, it is evident that for a given flow rate and a given suction specific speed, a reduction in RPM of the pump gives a marked reduction in the submergence required to maintain flow. Therefore, the driving of the inducer at slow speeds to generate the desired inlet head pressure for efficient operation of the main impeller is a very desirable objective. Further, the pumping of cryogenic fluids or fluids at their boiling point at low inlet head pressures produces amounts of vapor that are proportional to both the number of times the inducer vane cuts the fluid and the relative speed between the vane and the fluid. This vapor is not reabsorbed or condensed by the time it enters the main impeller and will impair the capacity of the main impeller because the vapor-liquid ratio reduces the head produced by the inducer due to the lower specific gravity of the mixture. By reducing the blades of the inducer to a minimum without unbalancing the inducer and by operating the inducer at lower speeds than the impeller, superior operating performance is obtained by this invention.

Further, the two blade inducer and its slower operating speed according to this invention, reduces the thrust load on the bearings of the units of this invention and, of course, reduces the operating power requirements.

Still further, the invention provides a second set of bearings 36 and 38 to back up the bearings 25 and 30 in the event of failure.

It is convenient, according to this invention, to use induction motors 31 and 40 with the motor 40 having the next available lowr induction motor speed. Thus, if the main motor 31 operates at a two pole speed, the next available lower speed for the motor 40 would be a four pole motor. Then if the main motor 31 is a four pole motor, the next available lower speed for the motor 40 would be a six pole motor. The relative speeds of such motors are as follows:

2-pole speed at 60 cycles is 3580 RPM
4-pole speed at 60 cycles is 1785 RPM
6-pole speed at 60 cycles is 1190 RPM Roughly, therefore, the speed of the inducer 59 would be about one-half the speed of the main impeller 52.

In the embodiment 10*a* of FIGS. 3 and 4, parts corresponding with parts described and illustrated in FIGS. 1 and 2 have been marked with the same reference numerals.

In this embodiment 10*a*, the electric motor 40 for driving the inducer 59 has been replaced with a turbine 80 including stator vanes 81 in the passages 16 and 46 and a turbine wheel 82 secured on the top end of the inducer drive shaft 34 above the top bearings 38. The impeller wheel 82 is thus driven by pumpage from the main impeller 52 flowing to the outlet pipe 11.

As shown in FIG. 4, the hub 60 of the inducer 59 has holes 83 through the bottom end thereof so that fluid in the inlet mouth 21 can flow through the bearing 57 to a chamber 84 in the upper end of the hub closed by a screw plug 85 closely surrounding the sleeve 56. This chamber has a ring of circumferentially spaced upright radial vanes 86 around the periphery thereof facing a ring of similar upright circumferentially spaced radial vanes 87 radiating from the sleeve 56. Side ports 88 vent the chamber to the pump inlet 22.

The cooperating vanes 86 and 87 form a hydraulic coupling for driving the inducer 59 from the main pump shaft 26 during start ups before the impeller wheel 82 receives enough pumpage to take over the driving of the inducer. Thus, when the fluid 13 is at a low level below the main impeller 52 as shown in FIG. 1, the inducer 59 must operate to feed the main impeller before the pumping can take place. The fluid for coupling the vanes 86 and 87 flows from the inlet 21 through the holes or ports 83 and out of the holes or ports 88 where it joins the fluid being discharged from the inducer vanes 63 and is fed to the main impeller vanes 65.

Thus, the arrangement of FIGS. 3 and 4 provides a slip coupling between the main drive shaft 26 and the inducer 59 serving to function as a drive on start ups before the turbine drive takes over.

The turbine wheel 82 can be designed to drive the inducer 59 at about two-thirds the speed of the main impeller 52.

In place of the hydraulic coupling in the embodiment of FIG. 10*a*, as shown in the embodiment 10*b* of FIG. 6, an electromagnetic coupling or clutch is provided between the main impeller shaft and the inducer hub. In this embodiment 10*b*, parts corresponding with parts described in FIGS. 1 to 6 have been marked with the same reference numerals. As shown in FIG. 6, a modified hub 90 for the inducer 59 is suspended on the bottom of the shaft 34 and is rotatably mounted on the bearing 57 around the reduced diameter bottom end portion 26*a* of the main motor shaft 26. The open top of this hub 90 is closed by a threaded in plug 91. A ring of circumferentially spaced spline teeth 92 project radially inwardly around the inner periphery of the top end of the hub 90 under the plug 91 and slidably mesh with outwardly projecting radial spline teeth 93 around the periphery of a floating clutch drum 94 surrounding and slidable on the shaft portion 26*a*.

A collar 95 is provided on the sleeve 56 which surrounds the shaft 26*a* below the drum 94 and is driven from the shaft 26. This collar has a ring 96 of brake or clutch material secured to its top face in opposed relation to the bottom face 94*a* of the drum 94. An annular solenoid or electromagnetic member 97 is mounted in the collar 95 and when energized through slip rings (not shown), it will pull the drum 94 downwardly against the action of leaf springs such as 98 carried by the plug 91 to provide a gripping engagement with the ring 96, thereby coupling the hub 90 through the spline teeth 92 and 93 and through the brake drum 94 with the collar 95 so that the hub 90 will rotate with the sleeve 56 and shaft portion 26*a*. This provides an electromagnetic clutch connection between the main motor shaft 26 and the impeller 59 that may be energized to couple the inducer for corotation with the main motor shaft. However, when the clutch is disconnected as by deenergizing the electromagnet 97, the springs 98 will lift the drum 94 and then only the shaft 34 will drive the hub 90. Thus, the electromagnetic clutch arrangement of FIG. 6 can be used in place of the hydraulic coupling arrangement of FIG. 4.

From the above descriptions it should, therefore, be understood that this invention provides substantial improvements in the art of submersible motor driven inducer equipped pump units and that the inducer mountings and drives of this invention increase the efficiency and decrease the power requirements of such pumps.

I claim as my invention:

1. In a submersible electric motor driven centrifugal pump unit with an inducer in the pump inlet ahead of the pump impeller supported on a hollow motor driven impeller shaft, the improvements of a second shaft extending through said hollow shaft coupled to said inducer, a turbine in the top end of said unit driven by pumpage from the impeller and driving said second shaft at a lower speed than said hollow shaft, and a coupling driving the inducer from the hollow shaft during start-ups of the unit.

2. A submersible electric motor driven centrifugal pump adapted for pumping cryogenic fluids and fluids at their boiling points which comprises a casing adapted to be mounted in the bottom of a tank having a bottom inlet and a top outlet, an electric motor in said casing, a hollow shaft driven by said motor, a centrifugal impeller mounted on said shaft receiving fluid from said inlet and discharging fluid through the casing to the outlet, a second shaft extending through said hollow shaft, an inducer in said pump inlet rotatable on said hollow shaft ahead of said impeller and driven by said second shaft, and a turbine in the upper end of said casing having a turbine wheel driving said second shaft and driven by pumpage from said impeller to rotate said inducer at a slower speed than said motor rotates said impeller.

3. A submersible electric motor driven centrifugal pump adapted for pumping cryogenic fluids and fluids at their boiling points which comprises a casing adapted to be mounted in the bottom of a tank having a bottom inlet and a top outlet, an electric motor in said casing, a hollow shaft driven by said motor, a centrifugal impeller mounted on said shaft receiving fluid from said inlet and discharging fluid through the casing to the outlet, a second shaft extending through said hollow shaft, an inducer in said pump inlet rotatable on said hollow shaft ahead of said impeller and driven by said second shaft, a turbine in the upper end of said casing having a turbine wheel driving said second shaft and driven by pumpage from said impeller to rotate said inducer at a slower speed than said motor rotates said impeller, and a hydraulic coupling receiving fluid from the inlet therethrough driving said inducer from said hollow shaft before the impeller supplies sufficient pumpage to drive the impeller wheel at a desired speed.

4. A submersible electric motor driven vertical pump unit having a downwardly opening pump inlet at the bottom thereof and an outlet at the top thereof which comprises nested outer and inner casings proving a flow path for pumpage therebetween, an electric motor housed in the inner casing, a hollow motor shaft rotatably mounted in the inner casing and extending therefrom into the inlet of the outer casing, a centrifugal pump impeller mounted on the extended portion of said hollow shaft having vanes receiving fluid from the inlet and discharging the fluid to the paths between the outer and inner casings to flow therethrough to the outlet, an inducer having a hub rotatably mounted on the extended end of said hollow shaft in said inlet with vanes radiating from the hub for feeding fluid from the pump inlet to the centrifugal impeller, a second shaft suspended from the top end of the inner casing extending freely through said hollow shaft and connected to said inducer hub for rotating the inducer, a coupling adapted to connect the inducer hub and the hollow shaft to drive the inducer from the electric motor, and a power source at the top end of said inner casing separate from said electric motor driving said second shaft at a speed less than the electric motor drives said hollow shaft whereby, the inducer will be rotated at a slower speed than the impeller.

5. A submersible electric motor driven centrifugal pump adapted for pumping cryogenic fluids and fluids at their boiling points which comprises a casing adapted to be mounted upright in the bottom of a tank having a bottom inlet and a top outlet, an electric motor in said casing, a hollow shaft driven by said motor, a centrifugal impeller mounted on said hollow shaft receiving fluid from said bottom inlet and discharging fluids through the casing to the top outlet, a second shaft extending through said hollow shaft, an inducer in said bottom inlet below said impeller rotatably supported on said hollow shaft and driven by said second shaft and a separate power source in the top of said casing driving said second shaft independently of said hollow shaft to rotate said inducer at a slower speed than said motor rotates said impeller.

6. The pump of 5 wherein the separate power source is an electric motor smaller than said electric motor driving said hollow shaft and is mounted in the upper end of said casing around the upper end of said second shaft.

7. The pump of claim 5 including bearings separate from said hollow shaft mounted in the upper end of said casing and rotatably suspending the second shaft for independent rotation in the hollow shaft.

8. A submersible electric motor driven vertical pump unit having a downwardly opening pump inlet at the bottom thereof and an outlet at the top thereof which comprises nested outer and inner casings providing a flow path for pumpage therebetween, an electric motor housed in the inner casing, a hollow motor shaft rotatably mounted in the inner casing and extending therefrom into the downwardly opening pump inlet, a centrifugal pump impeller mounted on the extended portion of said hollow shaft and having vanes driven by said shaft receiving fluid from said inlet and discharging the fluid to the flow path between the outer and inner casings to flow through said flow path to the outlet at the top of the unit, an inducer in said inlet below said impeller having a hub freely rotatably mounted on said extended end portion of said hollow shaft with vanes radiating from the hub to feed fluid from the pump inlet to the centrifugal impeller, a second shaft suspended from the top end of said inner casing extending freely through said hollow shaft and connected to said inducer hub for rotating the inducer, a power source at the top end of said inner casing separate from said electric motor driving said second shaft at a speed less than the electric motor drives said hollow shaft, and a hydraulic coupling between the hollow shaft and said inducer receiving fluid from said inlet at a level below said centrifugal impeller to drive the inducer from said hollow shaft whereby said electric motor will drive the impeller and inducer during start-ups and the power source separate from the electric motor will drive the inducer when energized.

9. The pump unit of claim 8 wherein the separate power source is a second electric motor housed in an enclosure at the top end of the inner casing and is sized to drive the inducer at speeds of about one-half to two-thirds the speed of the impeller.

* * * * *